US008353499B2

(12) United States Patent
Conway et al.

(10) Patent No.: US 8,353,499 B2
(45) **Date of Patent: *Jan. 15, 2013**

(54) ROADWAY GUARDRAIL SYSTEM

(75) Inventors: Steven J. Conway, Marion, OH (US); Frederick Mauer, IV, Greenland, NH (US); Dallas James, Auckland (NZ)

(73) Assignee: Nucor Corporation, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/842,736

(22) Filed: Aug. 21, 2007

(65) Prior Publication Data

US 2009/0050863 A1 Feb. 26, 2009

(51) Int. Cl.
*E01F 15/04* (2006.01)

(52) U.S. Cl. ..... 256/13.1

(58) Field of Classification Search ..... 256/13.1, 256/21, 22, DIG. 5; 404/6, 9
See application file for complete search history.

(56) References Cited

U.S. PATENT DOCUMENTS

| | | | | | |
|---|---|---|---|---|---|
| 2,025,014 | A | * | 12/1935 | Brickman et al. | 256/13.1 |
| 2,101,176 | A | * | 12/1937 | Height | 256/13.1 |
| 2,520,313 | A | * | 8/1950 | Harris | 256/22 |
| 2,776,116 | A | * | 1/1957 | Brickman | 256/13.1 |
| 3,214,142 | A | * | 10/1965 | Brown et al. | 256/13.1 |
| 3,493,213 | A | * | 2/1970 | Ackerman | 256/13.1 |
| 4,126,403 | A | * | 11/1978 | Sweeney et al. | 403/2 |
| 4,655,434 | A | | 4/1987 | Bronstad | |
| 4,784,515 | A | | 11/1988 | Krage et al. | |
| 4,838,523 | A | | 6/1989 | Humble et al. | |
| 5,044,609 | A | | 9/1991 | Cicinnati et al. | |
| 5,125,194 | A | * | 6/1992 | Granger | 404/10 |
| 5,203,543 | A | | 4/1993 | Fleury | |
| 5,851,005 | A | * | 12/1998 | Muller et al. | 256/13.1 |
| 5,967,497 | A | | 10/1999 | Denman et al. | |
| 6,036,399 | A | * | 3/2000 | Schalk | 404/6 |

(Continued)

FOREIGN PATENT DOCUMENTS

EP 0 708 206 A1 4/1996

(Continued)

OTHER PUBLICATIONS

Standard Specifications for Construction of Roads and Bridges on Federal Highway Projects; US Department of Transportation Federal Highway Administration; FP-96 1996; US Government Printing Office, Washington DC, US.

(Continued)

*Primary Examiner* — Michael P Ferguson
(74) *Attorney, Agent, or Firm* — Moore & Van Allen, PLLC; Jeffrey R. Gray

(57) ABSTRACT

A roadway guardrail system including a rail, a plurality of support posts, and a plurality of fasteners assembly to redirect an impacting vehicle and dissipate a portion of the impacting vehicle's energy. A plurality of support posts each includes a slot extending along its length aligning with apertures in the rail and engaging with the rail through the apertures with fasteners including reinforcing members slidable along the slots in the posts. Alternatively, the rail has a plurality of laterally extending slots aligning with apertures in support posts and engaging with the support posts through the apertures with fasteners including reinforcing members slidable along the slots.

13 Claims, 10 Drawing Sheets

U.S. PATENT DOCUMENTS

| | | | | |
|---|---|---|---|---|
| 6,173,943 | B1 | 1/2001 | Welch et al. | |
| 6,254,063 | B1 | 7/2001 | Rohde et al. | |
| 6,328,284 | B2 | 12/2001 | Wilding | |
| 6,398,192 | B1 | 6/2002 | Albritton | |
| 6,488,268 | B1 | 12/2002 | Albritton | |
| 6,558,067 | B2 | 5/2003 | Ochoa | |
| 6,758,627 | B2 | 7/2004 | King | |
| 6,793,204 | B2 | 9/2004 | Albritton | |
| 6,902,150 | B2 | 6/2005 | Alberson et al. | |
| 6,932,327 | B2 | 8/2005 | Alberson et al. | |
| 6,962,328 | B2 * | 11/2005 | Bergendahl | 256/13.1 |
| 7,101,111 | B2 * | 9/2006 | Albritton | 404/6 |
| 7,234,687 | B2 | 6/2007 | King | |
| 7,878,485 | B2 * | 2/2011 | Conway et al. | 256/13.1 |
| 2006/0027797 | A1 | 2/2006 | Sicking et al. | |
| 2007/0063179 | A1 | 3/2007 | Alberson et al. | |
| 2008/0067484 | A1 * | 3/2008 | Amengual Pericas | 256/13.1 |
| 2009/0050864 | A1 * | 2/2009 | Conway et al. | 256/13.1 |

FOREIGN PATENT DOCUMENTS

| | | | |
|---|---|---|---|
| JP | 2005-120577 | A | 5/2005 |
| KR | 20-1998-0008281 | U | 4/1998 |
| KR | 10-2006-0026337 | A | 3/2006 |
| WO | WO-00/28147 | A1 | 5/2000 |

OTHER PUBLICATIONS

International Search Report and Written Opinion for PCT/US2008/072318, dated Feb. 18, 2009.

Australian Examination Report for Application No. 2008289335 dated April. 18, 2012.

Australian Examination Report for Application No. 2011101260 dated Nov. 8, 2011.

New Zealand Examination Report for Application No. 595646 dated Apr. 23, 2012.

* cited by examiner

ROADWAY GUARDRAIL SYSTEM

BACKGROUND AND SUMMARY OF THE DISCLOSURE

The present invention is related to roadway barriers and safety systems, and more particularly, to a roadway guardrail system having a rail and a plurality of support posts.

Along many roadways it may be hazardous for a vehicle to leave the roadway. As a result, roadway safety barriers, including guardrail systems, are used along roadways. The guardrail systems may act to contain and redirect an errant vehicle along such roadways. Such guardrail systems may dissipate some of the vehicle's energy through deformation of the rail or post, or both.

A guardrail system in the past may have included a plurality of rails secured to a plurality of support posts made of wood or steel. One type of rail was the "W-beam," which is a guardrail named after its characteristic shape. Other railing configurations such as thrie beams and box beams were also used. Support posts may have been made of wood, metal or a combination of both.

Wooden support posts had several drawbacks. Wooden support posts were susceptible to deterioration from environmental exposure. As a result, wooden posts may have been treated with certain chemicals to slow deterioration, but such chemical treatments created additional expense in handling and in disposing of the treated wood. Wooden support posts also may have been installed in foundation sleeves or concrete foundations, while adding material costs and labor costs that resulted in a more expensive installation. Moreover, the same chemicals that aid in prolonging the life of the wooden posts can make the disposal of the posts on replacement a hazardous waste.

The trend has been toward using steel support posts, rather than wooden support posts, due to savings in material cost, durability, reliability, and maintenance. Steel posts have been installed by driving the posts directly into the ground, with or without a foundation sleeve as desired. Steel posts also could be treated to slow the effects of environmental exposure from rust and the like.

For improved safety, break away steel support posts that allow for failure during a collision have been developed. However, the design of break away steel support posts has remained relatively unchanged over the years. Such break away designs in the past may have had I-beam posts with cutouts or apertures along a portion of the post. At least some of the cutouts could be sized to receive fasteners for coupling the guardrail beam to the post. Other designs had the post in two sections joined with rotatable or releasable couplings that connected the two sections of the post and failed upon a sufficient impact force. However, such prior steel posts required substantial time, money, and resources during fabrication, modification, and installation.

The state of the art in guardrail systems has been documented and applied through specifications used by the industry. The United States Department of Transportation Federal Highway Administration provides "Standard Specifications for Construction of Roads and Bridges on Federal Highway Projects," including a section for guardrails and support posts. Industry groups such as the American Association of State Highway and Transportation Officials AASHTO, the Associated General Contractors (AGC) of America, and the American Road & Transportation Builders Association ARTBA have developed "A Guide to Standardized Highway Barrier Hardware" that included specifications for guardrails and posts. These specifications teach a guardrail system having a guardrail bolted to a large wood post or a large I-beam steel post. In general, in the past larger posts in guardrail systems better withstood impact forces to redirect a vehicle along the direction of the roadway.

A roadway guardrail system is presently disclosed to dissipate a portion of an impacting vehicle's energy and enable an impacting vehicle to be redirected by the system. The roadway guardrail system may be installed adjacent a roadway, such as along median strips, roadway shoulders, or any other path that is likely to encounter vehicular traffic.

The disclosed roadway guardrail system may comprise a rail having a plurality of mounting apertures, a plurality of support posts each having a slot extending along a portion of the length of the post such that a portion of the slot aligns with a rail mounting aperture at a desired height, and a plurality of fasteners each capable of fastening the rail to more than one support post through the slots and the mounting apertures to support the rail with the posts, such that upon a vehicle impact with the rail the fasteners are adapted to slide along the slot in the support post.

Alternatively, the disclosed roadway guardrail system may comprise a plurality of support posts each having a mounting aperture, a rail having laterally extending slots traverse the length of the rail such that a portion of a slot aligns with a post mounting aperture at a desired rail height, and a plurality of fasteners capable of fastening the rail to the posts through the laterally extending slots and the mounting apertures to support the rail with the posts, such that upon a vehicle impact with the rail the fasteners are adapted to slide along the slots in the rail.

BRIEF DESCRIPTION OF THE DRAWINGS

Presently contemplated embodiments of the present guardrail system are described below by reference to the following figures.

DETAILED DESCRIPTION OF THE DRAWINGS

Figure 1:
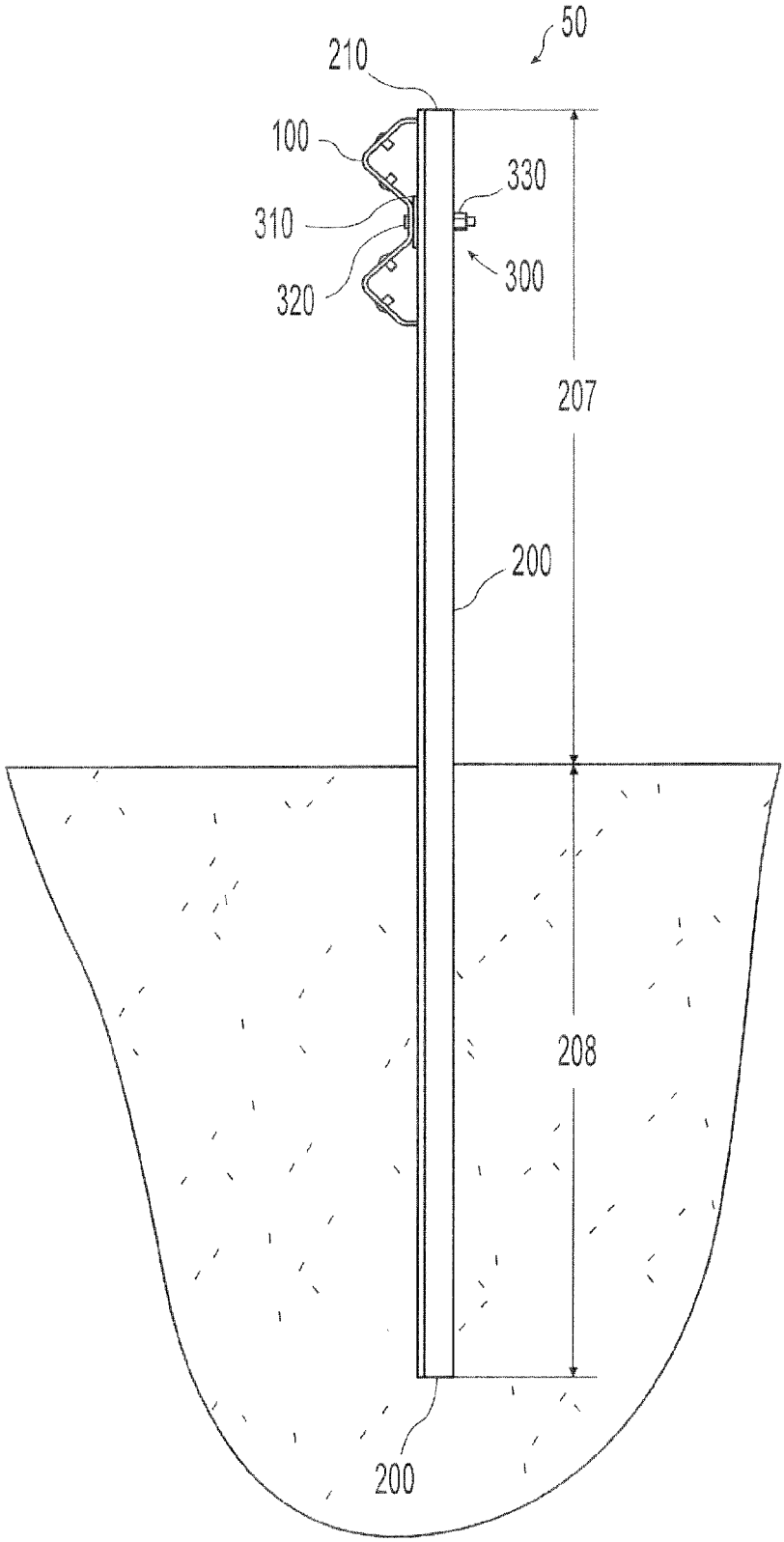
FIG. 1 is a side elevation view of a roadway guardrail system.
Figures 2, 3:
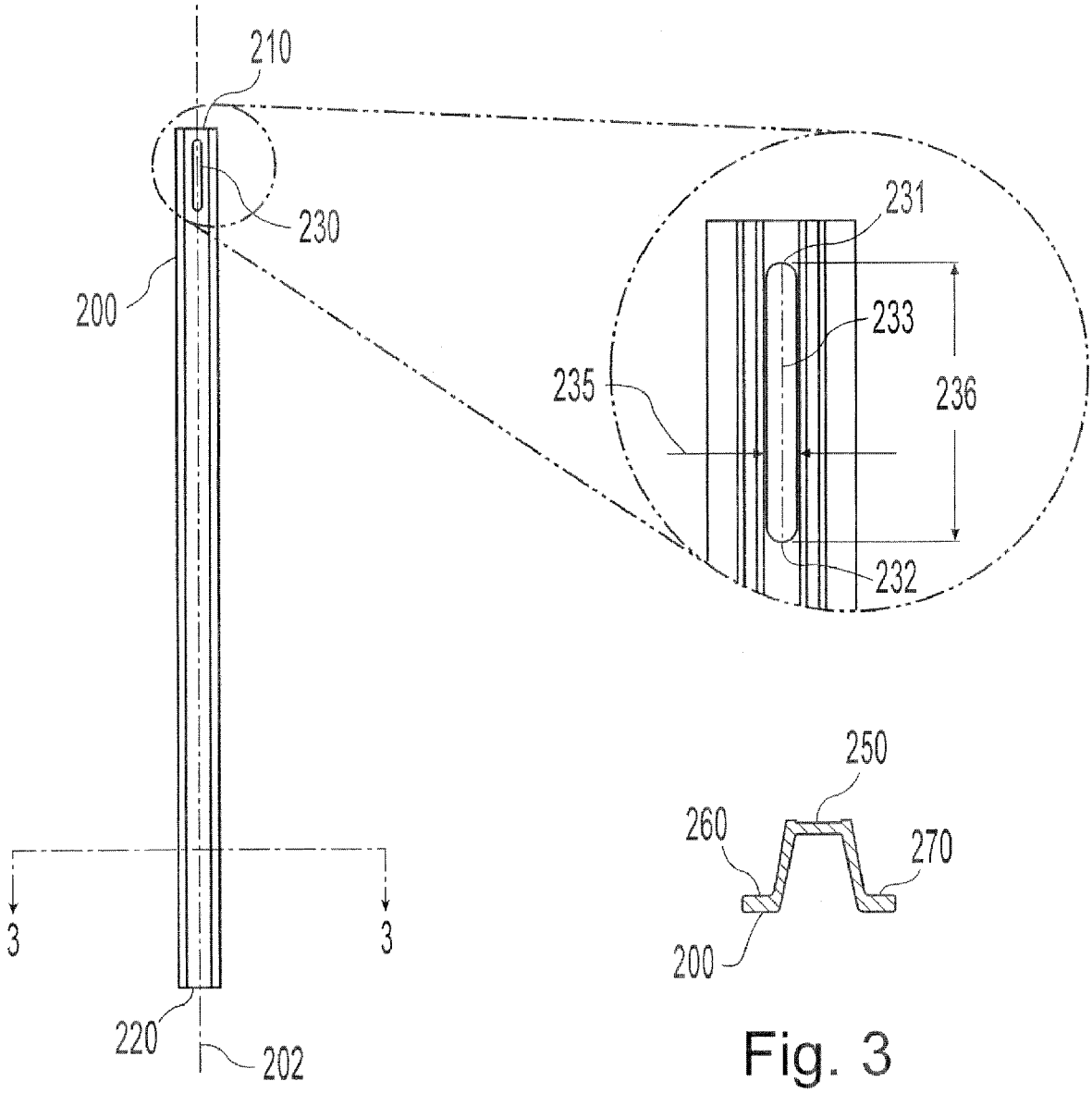
FIG. 2 is a front elevation view of a support post of a roadway guardrail system of FIG. 1.
FIG. 3 is a cross-sectional view of the support post of FIG. 2 taken along section line 3-3 in FIG. 2.

Referring generally to FIGS. 1 through 11, the present disclosure is a roadway guardrail system 50 operable to dissipate a portion of an impacting vehicle's energy and redirect the vehicle. The roadway guardrail system 50 may be installed adjacent a roadway along median strips, roadway shoulders, or at other locations likely to encounter vehicular traffic. As shown in FIG. 1, the roadway guardrail system 50 may comprise at least one rail 100 having a plurality of mounting apertures 110 and a plurality of support posts 200. As shown in FIG. 2, each support post 200 may have a slot 230 extending along the length of the post such that a portion of the slot 230 aligns with the rail mounting aperture 110 at a desired rail height. A fastener 300 is provided with the rail and support posts to be positioned through a mounting aperture 110 and a slot 230 to secure the rail 100 to a support post 200.

When the roadway guardrail system 50 is installed along the side of a roadway, the system is operable to dissipate a portion of an impacting vehicle's energy and to redirect the impacting vehicle along the general direction of the roadway. As the vehicle impacts the rail 100, the rail 100 may deflect and press against the support post 200 causing the support post 200 to deflect from its installed position. The deflection of the rail 100 and the support post 200 may dissipate a portion of the vehicle's impact energy. Additionally, forces and momentum from the vehicle impacting against the rail may cause the rail 100 to move relative to the support post 200 by the fastener 300 sliding within the slot 230, and maintaining the rail 100 in a retentive relationship and engage the vehicle to dissipate a further portion of the vehicle's impact energy and assist in redirecting the direction of the vehicle. As a result, the rail 100 may maintain contact with the impacting vehicle damping yaw, pitch, and roll of the impacting vehicle. If the impact force is sufficiently large, the support post 200 may fracture and dissipate more of the vehicle's impact energy.

The rail 100 may be a W-beam guardrail, as shown in FIG. 1. Alternately, other types of guardrail designs may be used, such as thrie beams, box beams, and other types of corrugated and non-corrugated guardrails. The guardrail may be constructed of 12 gauge steel, 10 gauge steel, or other steel of suitable strength. The rail may also be coated in galvanize or other suitable rust-resistant coating.

The support post 200 shown in FIG. 2 has a first end 210, a second end 220, and a post longitudinal axis 202 extending between the two ends. Near the first end 210, the support post 200 may include a slot 230 having a slot first end 231, a slot second end 232, a slot longitudinal axis 233, a slot width 235, and a slot length 236. The post longitudinal axis 202 may generally correspond to the centerline of the support post 200, as shown in FIG. 2. The slot longitudinal axis 233 may generally correspond to the centerline of the slot 230, and the slot 230 may be configured such that the slot longitudinal axis 233 is substantially aligned with the post longitudinal axis 202. The length 236 and width 235 of the slot 230 may be selected to obtain the desired energy dissipation and enable the guardrail system to redirect a vehicle. The width 235 of the slot 230 will also be selected for convenience in assembly of the guardrail system.

Figure 6:
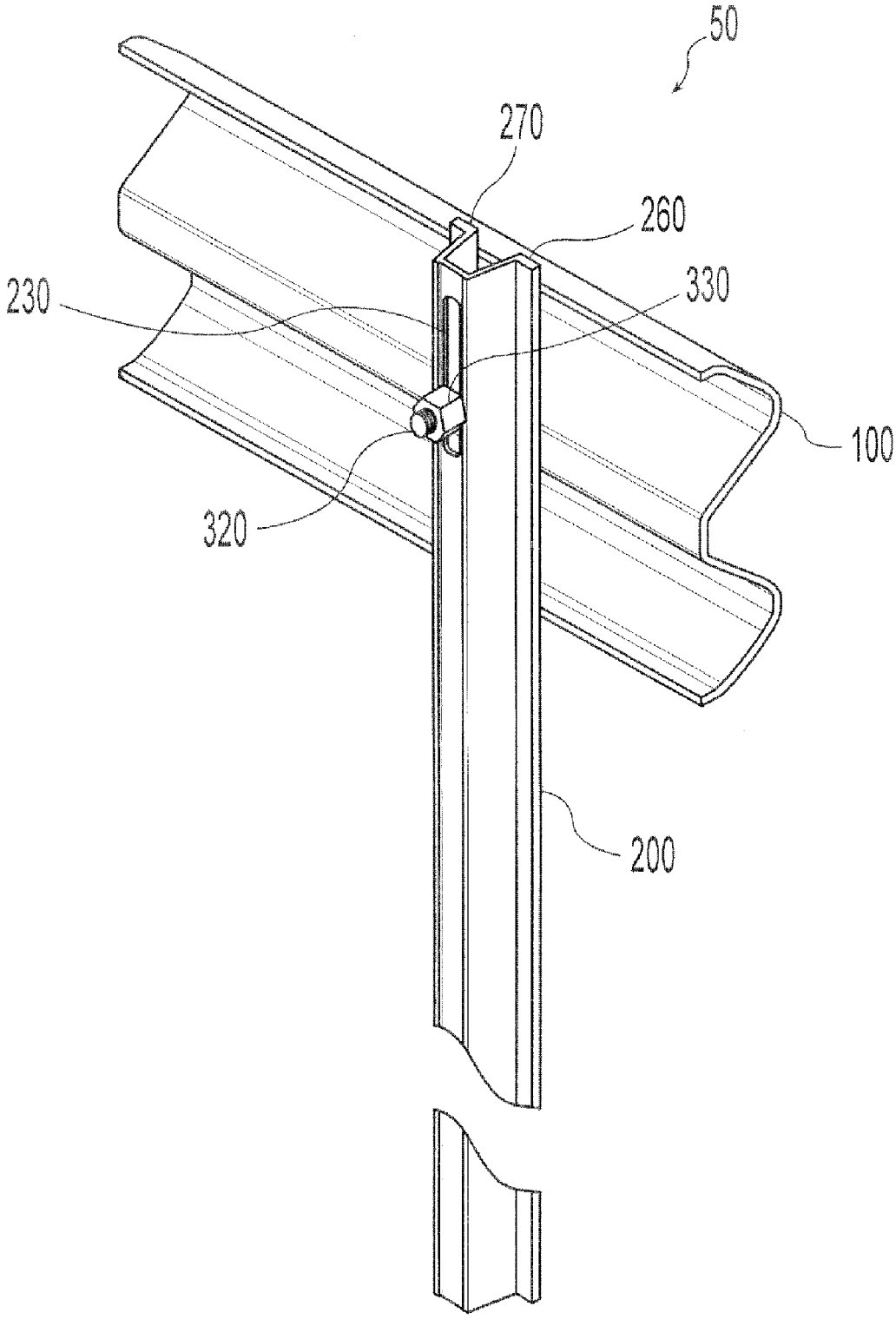
FIG. 6 is a perspective view of the roadway guardrail system of FIG. 1.

As shown in FIG. 3, the support post 200 may be generally defined by a U-channel post having a central web 250 and formed with a dextral flange 260 and a sinistral flange 270 such that the support post 200 has a flanged, generally U-shaped cross-section. The dextral flange 260 and the sinistral flange 270 may be configured such that when the rail 100 is secured to the support post 200, portions of the flanges 260, 270 may be in contact with portions of the rail 100, as shown in FIG. 6. The support post 200 of FIGS. 2 and 3 may be of a design similar to the U-channel metal posts currently offered by Nucor Marion Steel under the RIB-BAK trademark. For example, the U-channel post may be about 2 inches (about 51 millimeters) deep and about 3½ inches (about 89 millimeters) wide. The weight of the U-channel post may be about 5 pounds per foot (about 7.44 kilograms per meter). Although the support post 200 may be shown as having a U-shaped cross-section, other configurations are contemplated as desired for a particular installation. The support post 200 may be any structural steel having a cross-sectional size and shape suitable for the installation, including but not limited to, I-beam, W-shape, S-Shape, C-shape, M-shape, MC-shape, structural angles, structural tees, flat bar, and pipe. In addition, the support post 200 may be formed as a solid or hollow post, with a variety of geometric cross-sectional configurations such as circular, square, or rectangular.

The support post 200 may be constructed of steel having carbon content between about 0.4% and 1.0% by weight. Alternately, the steel of the support post 200 may have carbon content in a range between about 0.69% and 0.75% by weight. In yet another alternate, the steel of the support post 200 may have carbon content in a range between about 0.40% and 0.45% by weight. The support post material may have yield strength between about 60,000 lbs/in$^2$ and about 100,000 lbs/in$^2$, and a tensile strength greater than about 80,000 lbs/in$^2$. Alternately, the support post 200 may have a yield strength greater than about 60,000 lbs/in$^2$ and a tensile strength greater than about 90,000 lbs/in$^2$. In yet another alternate, the support post 200 may have a yield strength greater than about 80,000 lbs/in$^2$ and a tensile strength greater than about 120,000 lbs/in$^2$. The yield strength may allow the support post 200 to provide sufficient support to resist the vehicle impact forces associated with a rail impact, and may then fracture to allow more energy to be absorbed.

The support post 200 may have a weight between about 2 and 7 pounds per foot of post length (between about 2.9 and 10.4 kilograms per meter). The weight of the support post 200 as shown in FIGS. 1-3 may be about 5 pounds per foot of post length (about 7.4 kilograms per meter). Alternately, the weight of the support post may be between about 2 and 5 pounds per foot (between about 2.9 and 7.4 kilograms per meter). Prior steel support posts typically featured a weight of 8 pounds per foot of post length (about 11.9 kilograms per meter) or greater. Although these heavier support posts may be used, the support post 200 of the present disclosure may reduce the weight of the support posts and the accompanying cost of the posts. Further, our tests have shown that support posts 200 with a weight of about 5 pounds per foot of post length (about 7.4 kilograms per meter) having the configuration of FIG. 3, an exposed length 207 of 31 inches (about 0.79 meters), and a spacing of 75 inches (1.9 meters) between support posts 200 provide adequate deflection control and energy absorption to satisfy most if not all state and federal regulations.

By way of example, and not limitation, the support post 200 may be formed from U.S. new-billet steel, rail steel, or other types of steel alloys or other materials with the desired strength for the roadway guardrail system 50. Further, the support post 200 may have a coating of polyester to provide durability and protection against rusting. Alternatively, the support post 200 may be hot-dip coated with zinc, aluminum, chromate, zinc-aluminum alloy or other coating to provide protection against the elements.

The length of the support post 200 may be between about 50 inches (about 1.3 meters) and about 100 inches (about 2.5 meters). Alternately, the length of the support post 200 may be about 72 inches (about 1.8 meters) to about 78 inches (about 2.0 meters). When the support post 200 is installed, the exposed length 207 may be about 28 inches (about 0.7 meters) to about 34 inches (about 0.9 meters). An exposed length 207 in the range described corresponds to a rail height that may be about half the height of many cars and pickup trucks to redirect the vehicle along the direction of the guardrail upon impact.

The slot 230 may enable the rail 100 to move relative to the support post 200 under an impact force to absorb and dissipate energy and redirect the impacting vehicle. The slot 230 also provides an aperture through which the fastener 300 may extend to secure the rail 100 to the support post 200. The slot 230 may further provide installers with vertical adjustability when desired for mounting the rail 100 along a series of posts 200. Although the slot 230 is shown as having a generally rectangular shape with rounded ends, other geometries and configurations may be used in certain embodiments as desired.

The slot 230 has a slot width 235 capable of receiving the fastener 300 and allowing the fastener to slide within the slot. The slot 230 may be configured to inhibit the movement of the fastener 300 along the slot as the rail 100 moves along the support post 200 during impact of a vehicle with the guardrail system. The slot 230 may, for example, be tapered in slot width, serrated, or stepped or key-holed to inhibit movement of the fastener 30 along the slot. In any event, the slot may operate to slow the translational movement of the fastener 300 along the slot by providing a suitable amount of friction or binding by the fastener against the slot walls.

As noted, the slot length 236 may be any suitable length to allow for translational or sliding movement of the fastener 300 enabling the rail to move relative to the post to maintain retentive relationship and engage an impacting vehicle to dissipate impact energy and redirect the impacting vehicle. In the post shown in FIG. 2, the slot is about 7 inches (178 millimeters) in length. The slot 230 may be configured such that the fastener 300 may slide at least about 2 inches (about 51 millimeters) in the slot 230 before engaging the end of the slot. Movement of 2 inches (about 51 millimeters) or more may enable the rail and the impacting vehicle to at least momentarily maintain a retentive relationship, the rail approximately maintaining rail height as the post deflects. By maintaining a retentive relationship between the rail and the impacting vehicle, the guardrail system absorbs a portion of the impact energy and directs the engagement of the impacting vehicle with the guardrail.

The support post 200 may be designed such that the slot length 236 is correlated to the exposed length 207 of the support post 200 above ground. For example, the slot length 236 may be at least ten percent of the exposed length 207. In another example, the slot length 236 may be at least seventeen percent of the exposed length 207.

Alternately or in addition, the slot length 236 may be correlated to the spacing between support posts 200. The spacing between posts 200 may have an effect on the overall deflection of the roadway guardrail system 50. The deflection, in turn, may influence the amount of translational movement of the fastener 300 within the slot 230. If the deflection is greater, the permitted translational movement of the fastener 300 within the slot 230 may be adjusted to accommodate the desired deflection. Correlation between the slot length 236 and the post spacing may be from about 1:10 to about 1:20, and alternatively from about 1:12 to about 1:15.

In some guardrail installations the first end 210 of the support post 200 may not extend above the top of the rail 100. Also, it may be desired that the second end 232 of the slot 230 not extend below the bottom of the rail 100. Therefore, for such installations, it may be suitable that the slot length 236 be equal to or less than about the height of the rail 100, or alternatively, less than approximately 95% of the height of the rail 100. However, as the fastener 300 may be positioned at or near the second end 232 of the slot 230, it may be desired that the slot length 236 be about 50% of the height of the rail 100.

The slot 230 may be positioned on the support post 200 such that the distance between the slot first end 231 and the post first end 210 is greater than or equal to about 5% of the height of the rail 100. Further, the slot second end 232 may be positioned a distance from the post first end 210 of less than, or equal to, about 50% of the height of the rail 100.

The distance between the slot first end 231 and the first end 210 of the post 200 may affect the amount of force to cause the support post 200 to fracture. The slot may be positioned such that the slot first end 231 is spaced a distance less than about 10 slot widths 235 from the post first end 210.

Installation of the support post 200 may be completed using various techniques which are well known in the art. The particular technique used may depend upon the type of soil conditions and other factors associated with the roadway, and the type of hazard involved in installation of the roadway guardrail system 50. Additionally, the support post 200 may be installed with or without the use of metal foundation tubes or a concrete foundation.

Figure 8:
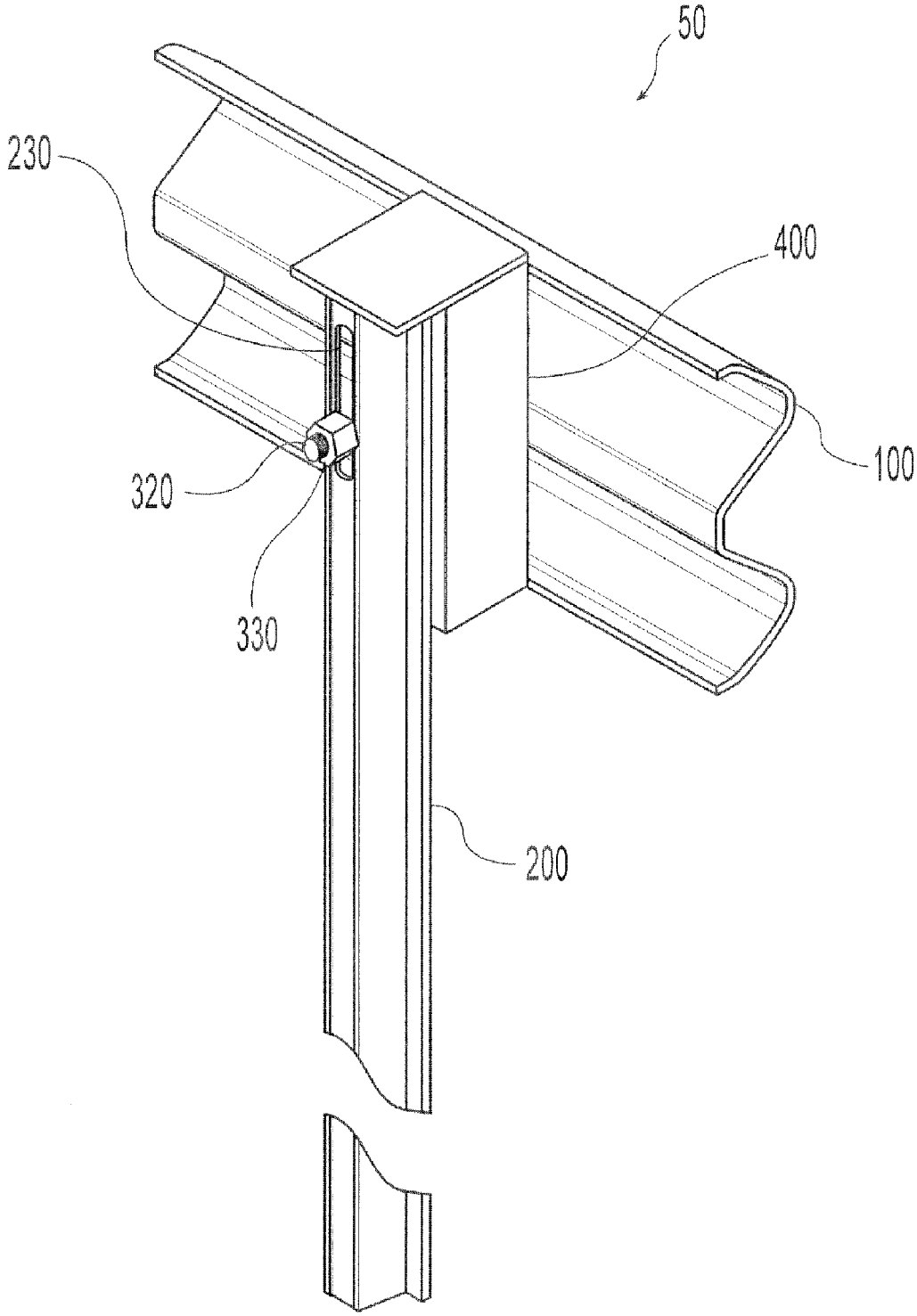
FIG. 8 is a perspective view of a second alternative roadway guardrail system.
Figure 11:
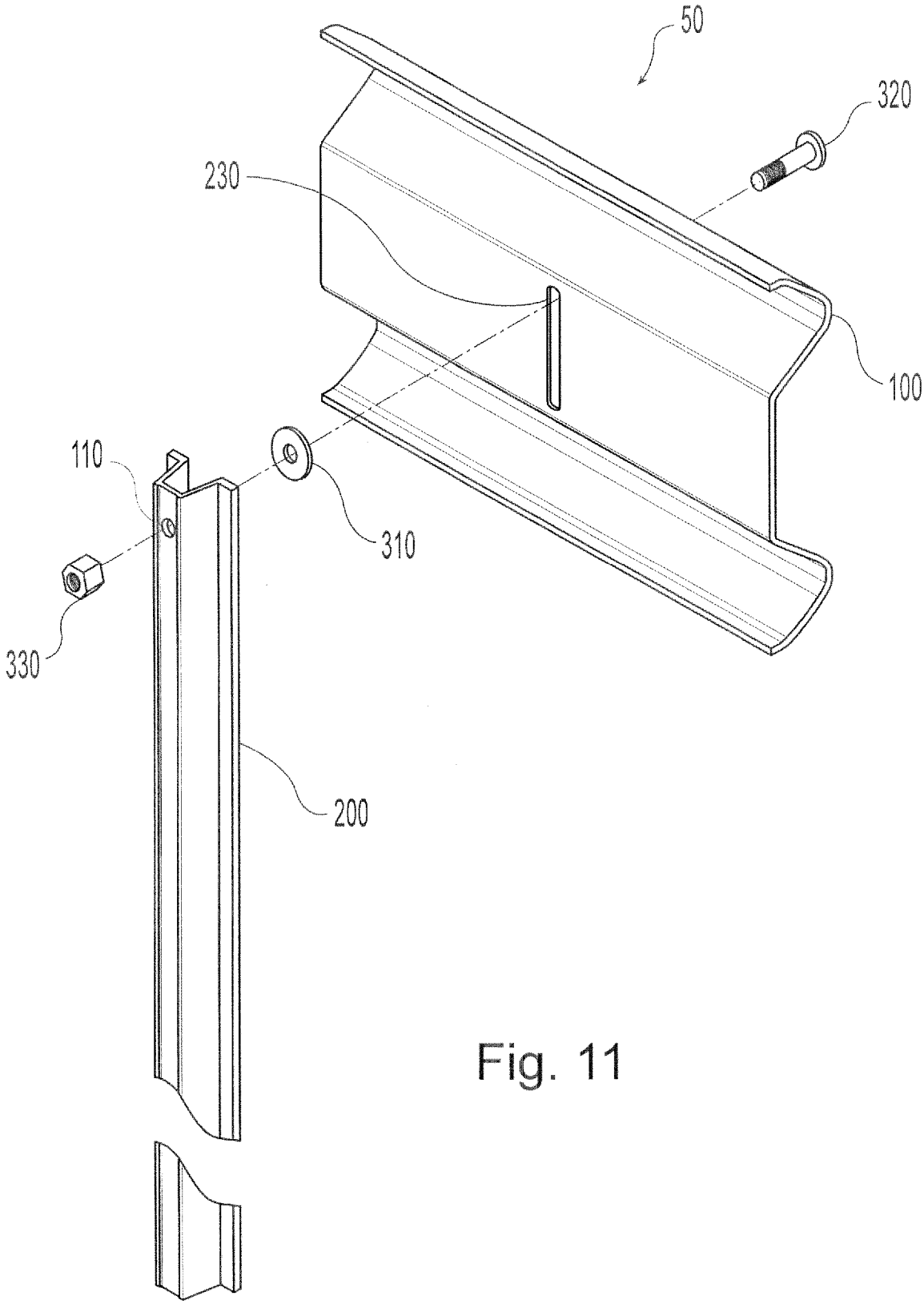
FIG. 11 is an exploded view of a third alternative roadway guardrail system.

As shown in FIGS. 1 and 11, the support post 200 may be installed in any orientation suitable for the purpose and location of the guardrail system. Along a relatively flat roadway, the support post 200 may be installed in an upright position, with the second end 220 embedded in the ground. On an embankment, abutment, or other inclined surface, the support post 200 may be installed in any detailed angular orientation relative to the ground. After installation, the support post 200 will in any event include an exposed length 207 and an embedded length 208, and the rail 100 joined to the support post 200 such that the rail 100 is transverse to the support post 200. In one example utilizing a U-shaped post, the support post 200 may be installed with the dextral flange 260 and sinistral flange 270 adjacent the rail 100 as shown in FIG. 6. The flanges 260, 270 may provide a contact surface for supporting the rail 100 and other guardrail hardware such as a block-out 400 as shown in FIG. 8.

Figure 9:
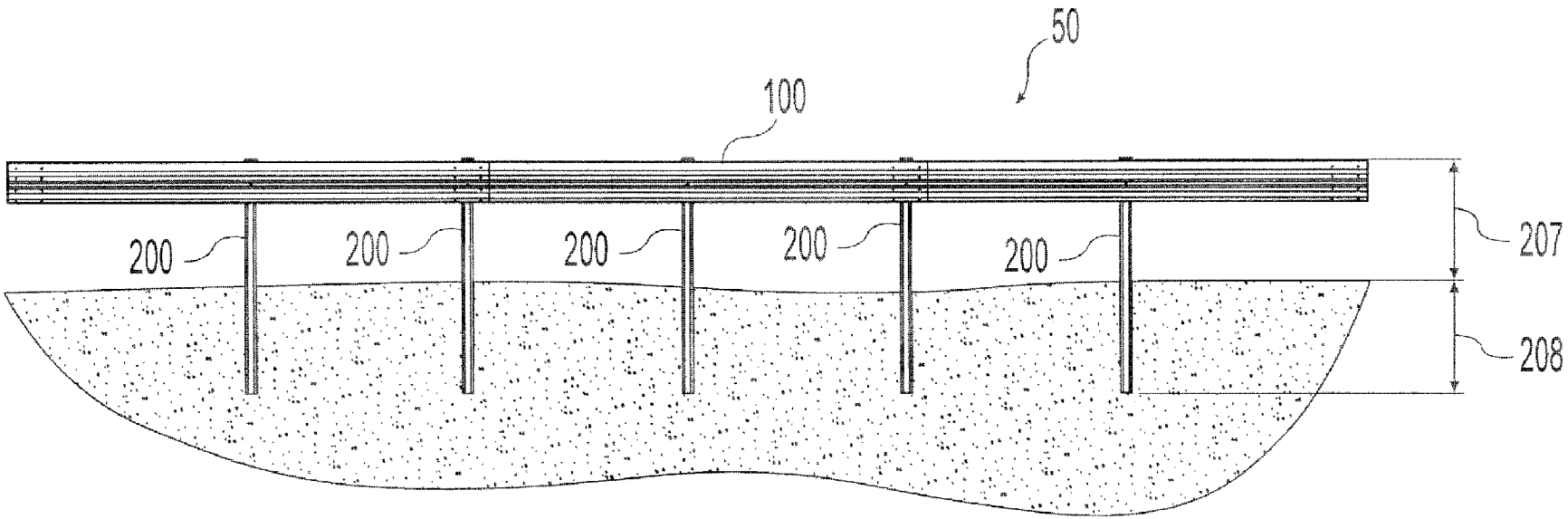
FIG. 9 is a front elevation view of a roadway guardrail system installed.

As shown in FIG. 9, a series of posts 200 may be used to support a plurality of rail 100 sections. The spacing between adjacent posts 200 affects the performance of the roadway guardrail system 50. As the post spacing is decreased, the overall deflection of the roadway guardrail system 50 will likely decrease. Similarly, as the post spacing is increased, the overall deflection of the roadway guardrail system 50 will likely increase. In FIG. 9, the spacing between support posts 200 is about 6 feet (about 1.8 meters). The spacing between support posts 200 may be increased or decreased to regulate the desired deflection of the guardrail system under impact load.

Figure 4:
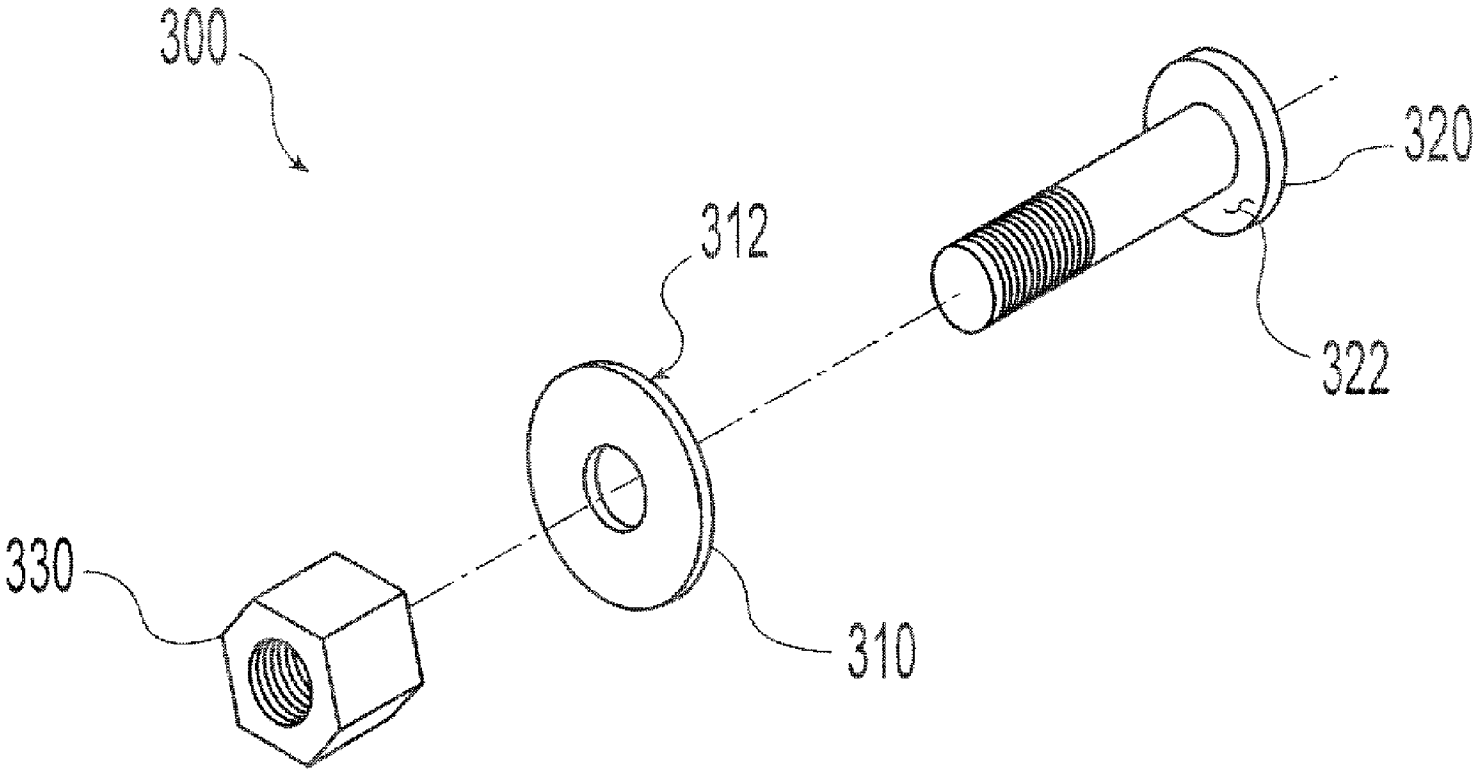
FIG. 4 is an exploded view of a fastener system of a roadway guardrail system of FIG. 1.
Figure 5:
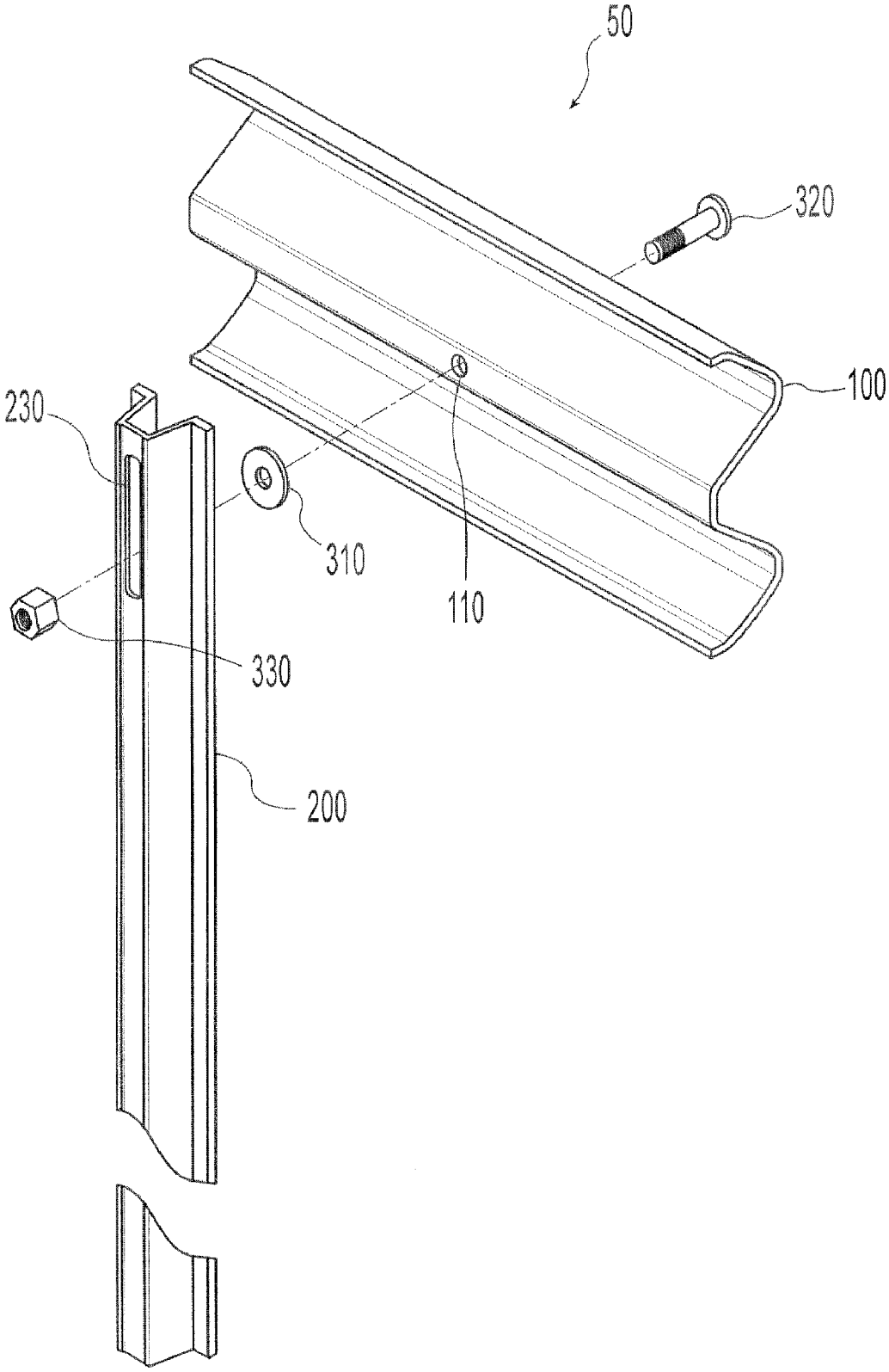
FIG. 5 is an exploded view of the roadway guardrail system of FIG. 1.
Figure 7:
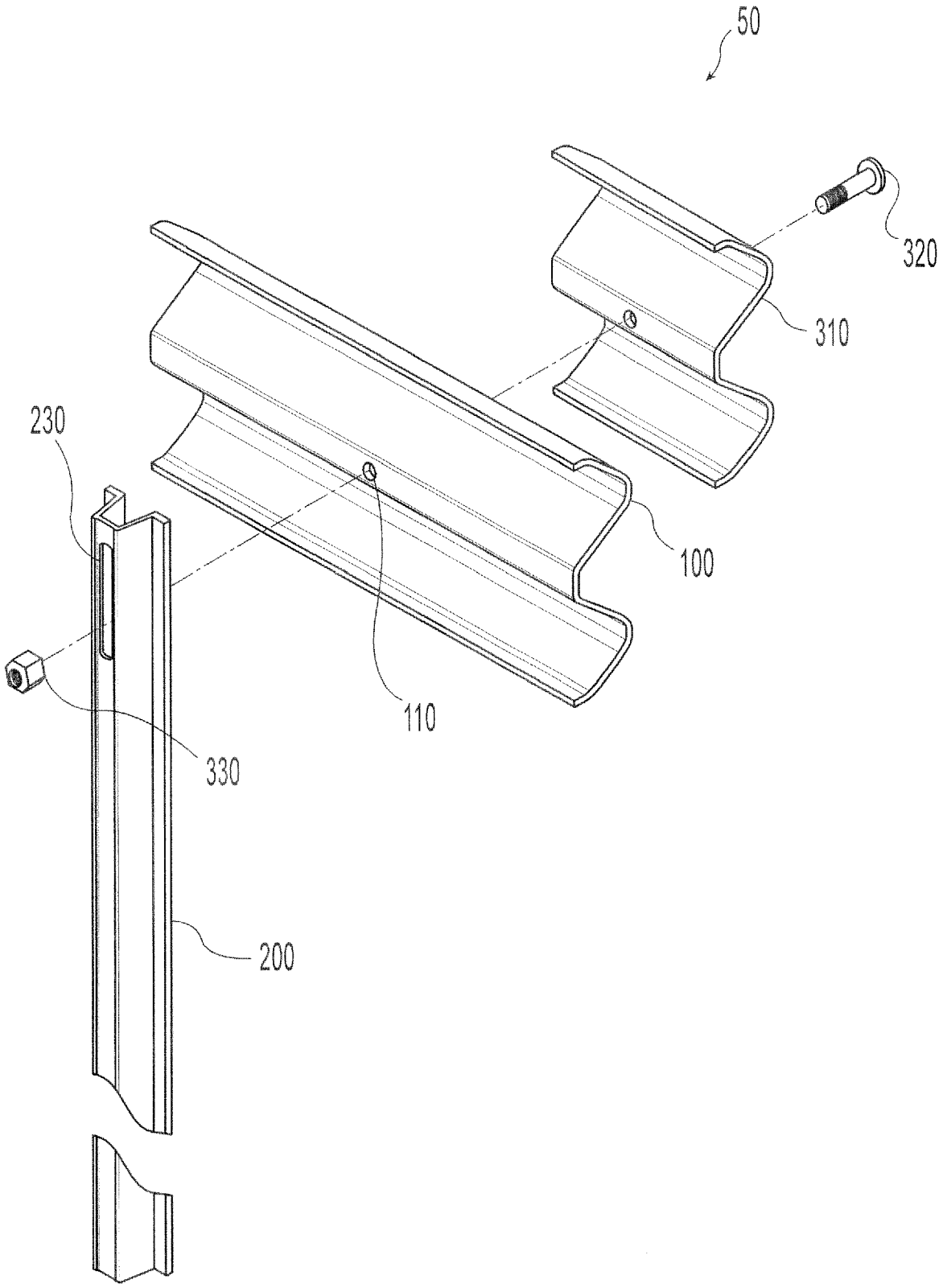
FIG. 7 is an exploded view of an alternative roadway guardrail system.

Referring to FIGS. 1 and 4, after installation of the support post 200, the rail 100 is releasably assembled with the support post 200 by the fastener 300. As seen in FIG. 4, the fastener 300 may include a reinforcing member 310, a post bolt 320 such as but not limited to ⅝ inch×3½ inch (15.9 millimeter× 88.9 millimeter) post bolt, and a nut 330 such as but not limited to a splice nut. By way of example, and not limitation, the reinforcing member 310 may be a washer as shown in FIG. 5 that spans the U-shaped part of the support post 200 and may be round, square, or rectangular shape. Alternatively, instead of or in addition to a washer, the reinforcing member 310 may include an additional section of rail as illustrated in FIG. 7, or may be disposed between the rail 100 and the support post 200, or located on the opposite side of the rail 100. The washer allows the rail connection to slide up in the slot while offering support and not yielding to the point of premature fracture of the post or allowing the vehicle to penetrate the guardrail system.

Figure 10:
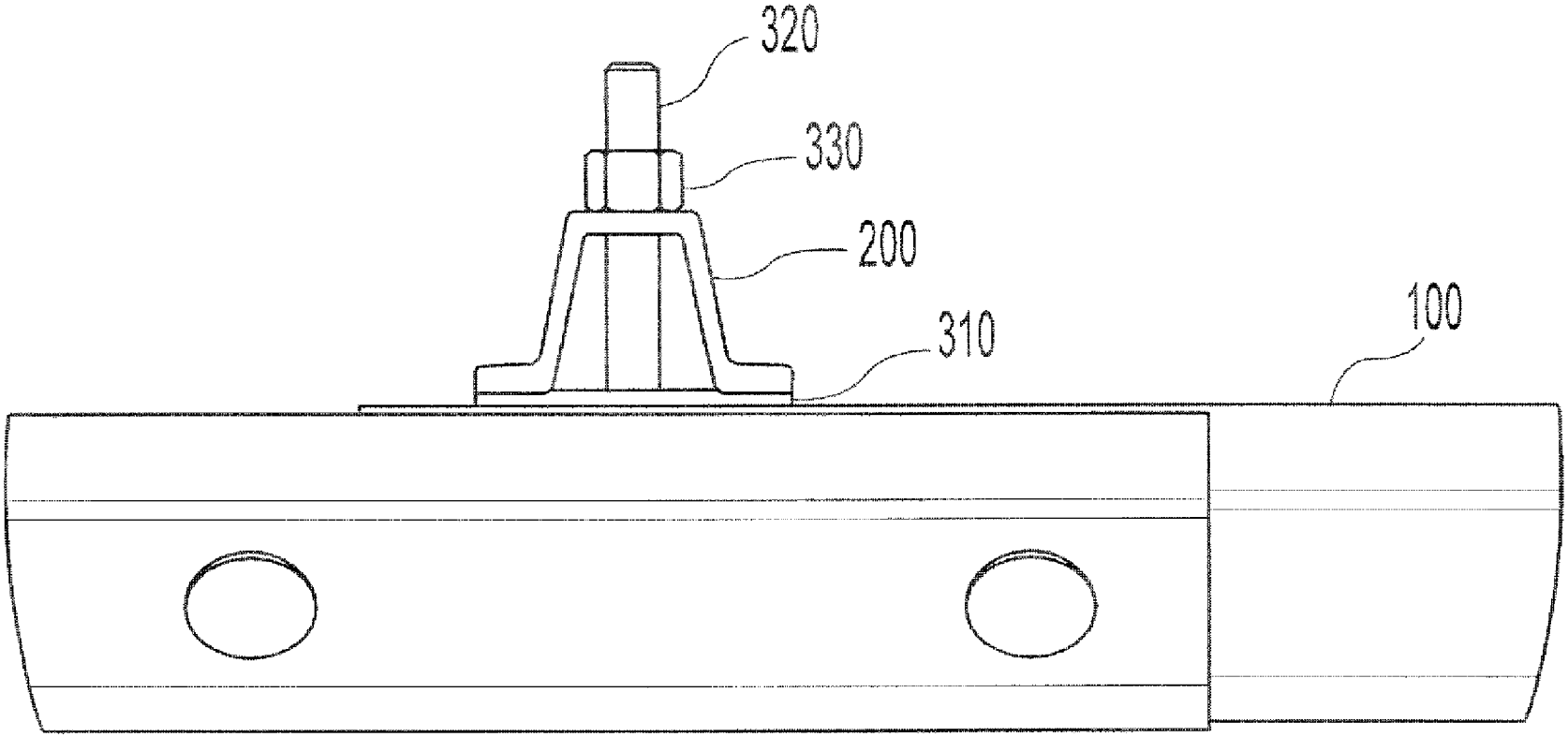
FIG. 10 is a top elevation view of a roadway guardrail system shown in FIG. 5.

In FIGS. 5 and 10 the reinforcing member 310 is disposed between the rail 100 and the support post 200. The reinforcing member 310 may facilitate sliding or translational movement of the fastener 300 within the slot 230. For example, a flat washer may be used as the reinforcing member 310, such as but not limited to a round spacer washer manufactured from ¼" (6.35 mm) mild steel plate with an outside diameter of about 3½ inch (about 89 millimeter) and a centrally located hole of about 1 inch (25.4 millimeter) in diameter. The washer may have a hot dip zinc, chromate, or other finish. The washer is captured in place by the post bolt 320 and nut 330. The washer may slide along the support post 200 enabling the fastener 300 to slide within the slot 230 when the rail 100 is impacted by a vehicle and providing a backing surface for the guardrail to reduce the possibility of the head of the post bolts from pulling though the guardrail. Alternatively, the reinforcing member 310 may have high friction surfaces to inhibit the translational movement of the fastener 300 within the slot 230. When the fastener 300 slides within the slot 230, such high friction surfaces of the reinforcing member 310 interact with the support post 200 and the rail 100 to further dissipate energy and assist in redirecting a vehicle impacting the guardrail system. The reinforcing member 310 may have a coefficient of friction at least 5% greater than the coefficient of friction of the contacting surfaces of the support post 200.

Similarly, the support post 200 may include friction enhancing surface characteristics in at least a portion of the area contacting the reinforcing member 310, or rail 100, during the fastener's 300 translational movement in the slot 230. Such surface characteristics may enhance the system's ability to dissipate energy and redirect an impacting vehicle. The friction enhancing surface characteristic may include virtually all types of surface patterns. Additionally, the friction enhancing surfaces of the support post 200 and the reinforcing member 310 contact one another to enhance energy dissipation.

Referring to FIG. 7, the reinforcing member 310 may be disposed on the outside surface of the rail 100, with the rail 100 directly abutting the support post 200. This assembly may facilitate installation of the roadway guardrail system 50 because the support post 200 directly contacts the rail 100.

The configuration of FIG. 7 provides the rail 100 increased thickness at each support post 200 and increases the amount of material the bolt 320 would need to tear through to separate from the rail 100. Also, the reinforcing bearing surface area 312 is larger than the bolt bearing surface area 322. An enlarged reinforcing bearing surface area 312 also provides additional strength to the reinforcing member 310, making it more difficult for the bolt 320 to separate from the rail 100. In one example, the reinforcing bearing surface area 312 is at least five times larger than the bolt bearing surface area 322.

The reinforcing member 310 may have at least the same thickness and yield strength as the rail 100. In FIG. 7, the reinforcing member 310 is a small section of rail that contacts the main rail 100. Although the reinforcing member 310 is shown in front of the rail 100, the reinforcing member 310 may also be disposed between the rail 100 and the support post 200.

Alternately or in addition, a block-out 400 may be positioned between the rail 100 and the support post 200. The block-out 400 may be about 14 inches×3⅝ inches (about 355.6 millimeter×92.1 millimeter) and provides a lateral offset of about 8 inches (203 millimeter) between the support post 200 and the rail 100. The distance and direction of the lateral offset may be selected such that the wheels of an impacting vehicle are less likely to strike the support post 200 during a rail impact. The block-out 400 may have a projection that mounts on top of the support post 200 and a projection that contacts the particular cross-section or contour of the support post 200 to facilitate installation. The plastic block-outs may be manufactured from a 50% blend of new and recycled HDPE (high density polyethylene).

When block-outs 400 are used, the fastener 300 may include a longer post bolt 320 such as but not limited to a ⅝ inch×12 inch (15.9 millimeter×304.8 millimeter) post bolt, with the nut 330 such as but not limited to a splice nut.

Referring now to FIG. 11, the roadway guardrail system 50 may comprise a plurality of support posts 200 each having a mounting aperture 110 and a rail 100 having laterally extending slots 230 extending traverse the length of the rail such that a portion of a slot aligns with a post mounting aperture at a desired rail height. A fastener 300 may be positioned through the mounting aperture 110 in the support post 200 and the slot 230 in the rail 100 to secure the rail 100 to the support post 200. As previously discussed, a reinforcing member 310 may be disposed between the rail 100 and the support post 200. Alternatively, the reinforcing member 310 may be located on the opposite side of the rail 100.

The rail 100 may be a W-beam guardrail, thrie beam, box beam, or other type of corrugated or non-corrugated guardrail. The rail 100 may be configured to accommodate the slot 230 extending traverse the length of the rail adjacent each support post 200 location along the length of the rail.

The fastener 300 may be positioned at or near the first end of the slot 230 in the rail 100. When a vehicle impacts the rail 100, forces may cause the rail 100 to move relative to the support post 200 such that the fastener 300 may slide within the slot 230 in the rail 100 thereby dissipating a portion of the vehicle's impact energy and assisting in redirecting the impacting vehicle. Additionally, deflection of the rail 100 and the support post 200 may also dissipate a portion of the vehicle's impact energy and assist in redirecting the impacting vehicle. If the impact force is sufficient, the support post 200 may fracture further dissipating the vehicle's impact energy.

While the invention has been described with detailed reference to one or more embodiments, the disclosure is to be considered as illustrative and not restrictive. Modifications and alterations will occur to those skilled in the art upon a reading and understanding of this specification. It is intended to include all such modifications and alterations in so far as they come within the scope of the claims, or the equivalents thereof.

What is claimed is:

1. A roadway guardrail system comprising:

a roadway guardrail having one or more mounting apertures;

one or more roadway guardrail posts with a u-shaped cross-section each having a first end, a second end, two flanges with front surfaces and defining a channel therebetween, and a slot extending along a portion of the length of the roadway guardrail posts within the channel near the first end of the roadway guardrail posts and wherein the second end is configured for being operatively coupled to the ground;

one or more reinforcing members having a first surface and a second surface and an aperture therethrough;

one or more fasteners, each extending through a respective one of the mounting apertures, an aperture of the reinforcing members, and the slots;

wherein the roadway guardrail is operatively coupled to the one or more roadway guardrail posts by the one or more fasteners, and wherein each of the one or more reinforcing members is located between the roadway guardrail and a respective one of the one or more roadway guardrail posts; such that the first surface of the reinforcing members engages the front surfaces of the two flanges of the roadway guardrail post and the second surface of the reinforcing member engages a surface of the roadway guardrail;

wherein a portion of each slot aligns with one of the one or more mounting apertures at a desired height of the roadway guardrail;

wherein upon a vehicle impact with the roadway guardrail the one or more fasteners, the one or more reinforcing members, and the roadway guardrail slide upwards with respect to the one or more guardrail posts, such that the one or more reinforcing members slide upwards with respect to the front surfaces of the two flanges of the one or more roadway guardrail posts along at least one of the one or more slots; and wherein the upward movement of the one or more fasteners, the one or more reinforcing members, and the roadway guardrail is inhibited when at least one of the one or more fasteners contacts an end of the at least one of the one or more slots, such that energy of the collision is dissipated as the one or more reinforcing members slide with respect to the front surfaces of the flanges of the one or more roadway guardrail posts and the at least one of the one or more fasteners contacts the end of the at least one of the one or more slots.

2. The roadway guardrail system of claim 1 further comprising:

a second reinforcing member adapted to be operatively coupled to the roadway guardrail; and wherein the second reinforcing member can be is operatively coupled on a front surface of the roadway guardrail and a respective one of the fasteners extends through the second reinforcing member.

3. The roadway guardrail system of claim 1 wherein each fastener comprises a nut threadably engaging a bolt.

4. The roadway guardrail system of claim 3 wherein the one or more reinforcing members are washers.

5. The roadway guardrail system of claim 1 wherein at least one of the roadway guardrail mounting apertures is a guardrail slot extending along a length of the roadway guardrail and traverses at least one of the slots in the one or more roadway guardrail posts.

6. The roadway guardrail system of claim 1 wherein the one or more slots are at least about 2 inches in length and permit the one or more fasteners at least about 2 inches of translational movement along the slot in the upward direction.

7. A roadway guardrail system comprising:

a roadway guardrail having a plurality of mounting apertures;

a plurality of roadway guardrail posts each having a first end, a second end, a front surface defining a channel therein, and a slot extending along a portion of the length of each roadway guardrail post within the channel near the first end of the roadway guardrail posts and wherein the second end is configured for being operatively coupled to the ground, such that a portion of the slot aligns with one of the plurality of mounting apertures at a desired height of the roadway guardrail;

a plurality of reinforcing members each having a first surface and a second surface and an aperture therethrough;

a plurality of fasteners each fastening the roadway guardrail to a reinforcing member of the plurality of reinforcing members and to a roadway guardrail post of the plurality of roadway guardrail posts and extending through a mounting aperture of the plurality of mounting apertures of the roadway guardrail, the aperture of a respective one of the reinforcing members, and the slot in a respective one of the roadway guardrail posts;

wherein the first surface of the reinforcing member engages the front surface of the roadway guardrail post, and the second surface of the reinforcing member engages a surface of the roadway guardrail;

wherein upon a vehicle impact with the roadway guardrail the fastener, the reinforcing member, and the roadway guardrail slide upwardly along the slot in the roadway guardrail post; and wherein the engagement between the first surface of the reinforcing member and the front surface of the roadway guardrail post inhibit the movement of the fastener, the reinforcing member, and the roadway guardrail to dissipate energy of the collision, and the upward movement of the fastener, the reinforcing member, and the roadway guardrail is further inhibited to dissipate the energy of the collision when the fastener contacts an end of the slot.

8. The roadway guardrail system of claim 7 further comprising:

a second reinforcing member adapted to be operatively coupled to the roadway guardrail; and wherein the second reinforcing member can be is operatively coupled on a front surface of the roadway guardrail and a respective one of the fasteners extends through the second reinforcing member.

9. The roadway guardrail system of claim 7 wherein each fastener comprises a nut threadably engaging a bolt to fasten the roadway guardrail to one of the roadway guardrail posts.

10. The roadway guardrail system of claim 9 wherein each of the reinforcing members is a washer.

11. The roadway guardrail system of claim 7 wherein at least one of the roadway guardrail mounting apertures is a guardrail slot extending along a length of the roadway guardrail and traverses at least one of the slots in the one or more roadway guardrail posts.

12. The roadway guardrail system of claim 7 wherein each of the slots is at least about 2 inches in length and permits the fasteners at least about 2 inches of translational movement along the slot in the upward direction.

13. A roadway guardrail system comprising:

a roadway guardrail having one or more mounting apertures;

one or more roadway guardrail posts each having a first end, a second end, a front surface defining a channel therein, and a slot longitudinally extending along at least about 2 inches of the length of the roadway guardrail posts within the channel near the first end of the roadway guardrail posts and wherein the second end is configured for being operatively coupled to the ground;

one or more reinforcing members having a first surface and a second surface and an aperture therethrough;

one or more fasteners, each extending through a respective one of the mounting apertures, an aperture of the reinforcing members, and the slots;

wherein the roadway guardrail is operatively coupled to the one or more roadway guardrail posts by the one or more fasteners, and wherein each of the one or more reinforcing members is located between the roadway guardrail and a respective one of the one or more roadway guardrail posts; such that the first surface of the reinforcing members engages the front surface of the roadway guardrail posts and the second surface of the reinforcing members engages a surface of the roadway guardrail;

wherein a portion of each slot aligns with one of the roadway guardrail mounting apertures;

wherein upon a vehicle impact with the roadway guardrail the one or more fasteners, the one or more reinforcing members, and the roadway guardrail slide upwards at least about 2 inches with respect to the one or more guardrail posts, such that the one or more reinforcing members slide upwardly along the front surface of the one or more guardrail posts, such that the engagement of the first surface of the one or more reinforcing members with the front surface of the one or more roadway guardrail posts dissipates energy from the collision; and wherein the upward movement of the one or more fasteners, the one or more reinforcing members, and the roadway guardrail is inhibited when the fastener contacts an end of the slot, which further dissipates the energy of the collision.

* * * * *

UNITED STATES PATENT AND TRADEMARK OFFICE

CERTIFICATE OF CORRECTION

PATENT NO. : 8,353,499 B2
APPLICATION NO. : 11/842736
DATED : January 15, 2013
INVENTOR(S) : Steven J. Conway, Frederick Mauer, IV and Dallas James It is certified that error appears in the above-identified patent and that said Letters Patent is hereby corrected as shown below:

In the Claims:

Claim 2, Column 9, Line 34 and Claim 8, Column 10, Line 28. Delete "(can be)".

Signed and Sealed this
Fourteenth Day of May, 2013

Teresa Stanek Rea
*Acting Director of the United States Patent and Trademark Office*